US009475618B2

(12) United States Patent
Wohlgenannt

(10) Patent No.: US 9,475,618 B2
(45) Date of Patent: Oct. 25, 2016

(54) CLOSING CAP, CONTAINER NECK, TAMPER-EVIDENT CLOSURE, AND METHOD FOR PRODUCING A TAMPER-EVIDENT CLOSURE

(71) Applicant: CAPARTIS AG, Schaffhausen (CH)

(72) Inventor: Herbert Wohlgenannt, Schaffhausen (CH)

(73) Assignee: CAPARTIS AG, Schaffhausen (CH)

( * ) Notice: Subject to any disclaimer, the term of this patent is extended or adjusted under 35 U.S.C. 154(b) by 0 days.

(21) Appl. No.: 14/435,161

(22) PCT Filed: Oct. 10, 2013

(86) PCT No.: PCT/EP2013/071198

§ 371 (c)(1),
(2) Date: Apr. 11, 2015

(87) PCT Pub. No.: WO2014/057054

PCT Pub. Date: Apr. 17, 2014

(65) Prior Publication Data

US 2015/0266631 A1 Sep. 24, 2015

(30) Foreign Application Priority Data

Oct. 11, 2012 (EP) ..... 12188256

(51) Int. Cl.
*B65D 41/34* (2006.01)
*B65D 1/02* (2006.01)
(Continued)

(52) U.S. Cl.
CPC ..... *B65D 41/3428* (2013.01); *B65D 1/0246* (2013.01); *B65D 41/3447* (2013.01); *B65D 41/46* (2013.01); *B65D 43/0281* (2013.01); *B65D 2101/0046* (2013.01)

(58) Field of Classification Search
CPC B65D 41/3428; B65D 41/46; B65D 1/0246; B65D 43/0281; B65D 41/3447; B65D 2101/0046
USPC ..... 215/44, 252, 258
See application file for complete search history.

(56) References Cited

U.S. PATENT DOCUMENTS 3,716,162 A 2/1973 Botkin
3,841,512 A 10/1974 Botkin
(Continued)

FOREIGN PATENT DOCUMENTS

EP 2314520 4/2011
GB 2307901 6/1997
(Continued)

OTHER PUBLICATIONS

International Search Report for PCT/EP2013/071198, English translation attached to original, Both completed by the European Patent Office on Feb. 20, 2014, All together 7 Pages.

*Primary Examiner* — James N Smalley
(74) *Attorney, Agent, or Firm* — Brooks Kushman P.C.

(57) ABSTRACT

A closing cap made of plastic for closing a container, having a head part and a jacket part, the jacket is substantially shaped like a hollow cylinder and has a longitudinal axis, the jacket extends from the head along the longitudinal axis, the jacket has an end segment at the end opposite the head. The closing cap has a tamper-evident part and bridge parts, wherein the tamper-evident part is arranged at a distance from the jacket and is connected to the end segment of the jacket by bridge parts. Additionally the tamper-evident part is arranged in the direction of extension of the longitudinal axis along the end segment, such that the tamper-evident part is arranged at a distance from the jacket in a direction radial to the longitudinal axis and extends in a circumferential direction to the longitudinal axis on the outside along the jacket.

14 Claims, 7 Drawing Sheets

(51) Int. Cl.
*B65D 41/46* (2006.01)
*B65D 43/02* (2006.01)

(56) References Cited

U.S. PATENT DOCUMENTS 4,261,478 A * 4/1981 Summers ..... B65D 41/3409 215/216
4,852,751 A 8/1989 Halfacre
2009/0120936 A1 5/2009 Zauser et al.

FOREIGN PATENT DOCUMENTS

JP H0858818 3/1996
WO 9514617 6/1995
WO 2007031162 3/2007

* cited by examiner

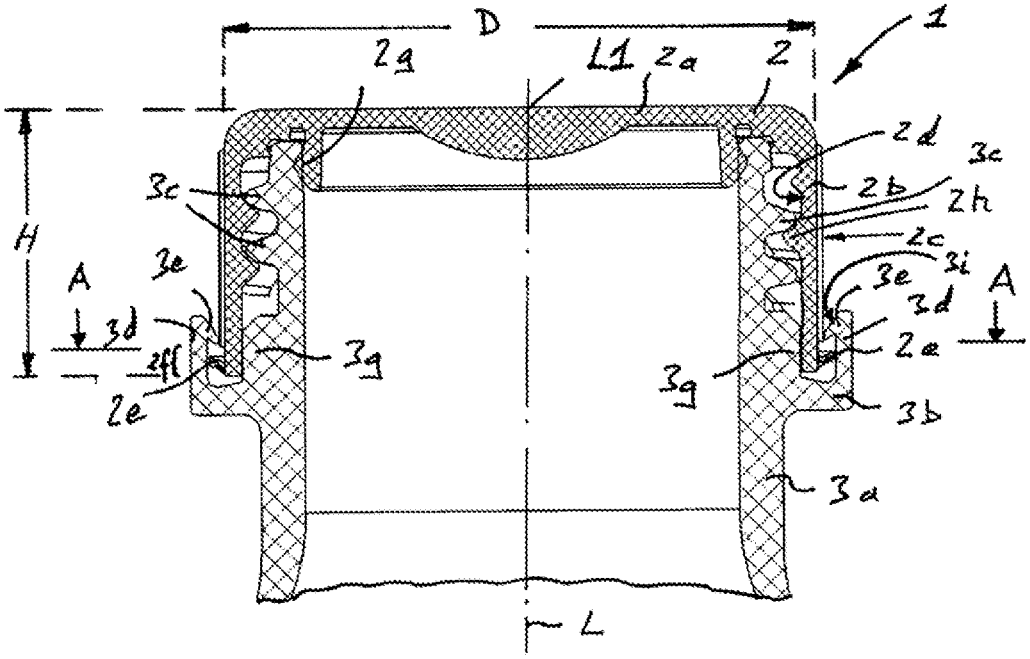
Figure 3
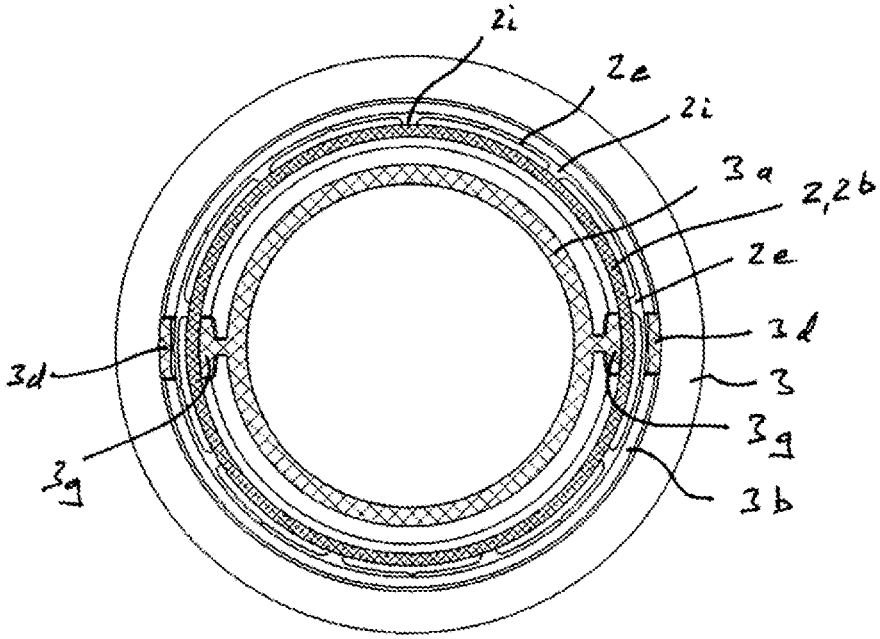
Figure 4 ( A - A )

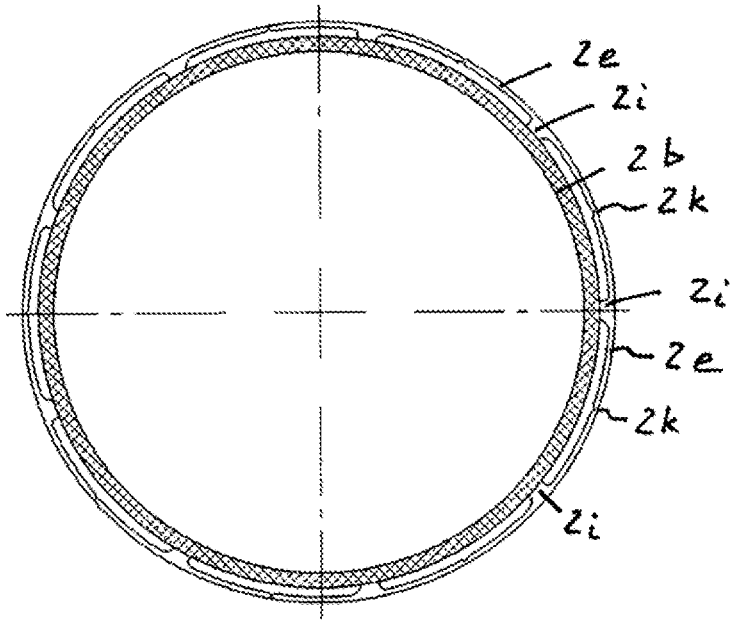
Figure9 ( B - B )
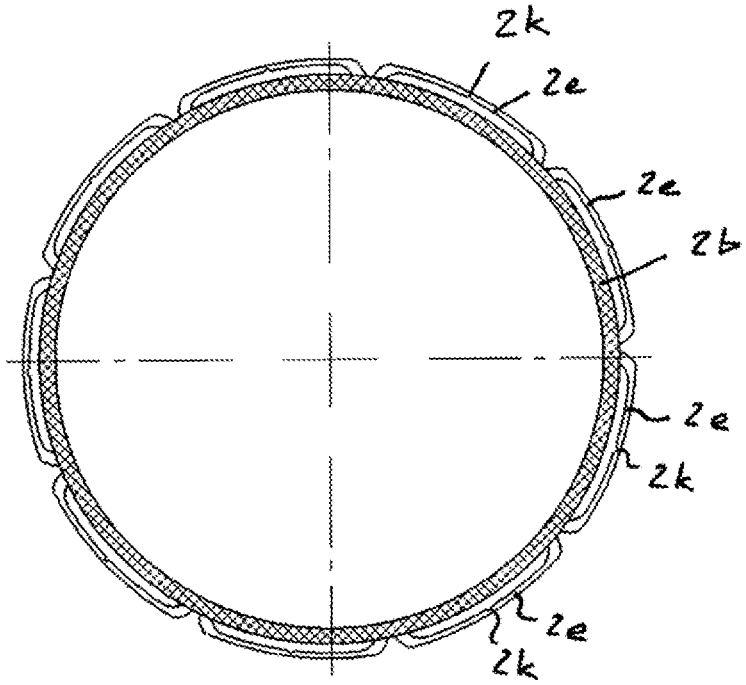
Figure 10

CLOSING CAP, CONTAINER NECK, TAMPER-EVIDENT CLOSURE, AND METHOD FOR PRODUCING A TAMPER-EVIDENT CLOSURE

CROSS-REFERENCE TO RELATED APPLICATION

This application is the U.S. national phase of PTC Application No. PCT/EP2013/071198 filed on Oct. 10, 2013, which claims priority to EP Patent Application No. 12188256.7 filed on Oct. 11, 2012, the disclosures of which are incorporated in their entirety by reference herein.

DESCRIPTION

The invention relates to a closing cap and to a container neck. The invention further relates to a tamper-evident closure comprising the closing cap and the container neck. The invention further relates to a method for producing the tamper-evident closure.

PRIOR ART

The document WO 2007/031162 discloses a tamper-evident screw closure for containers and bottles. The tamper-evident screw closure is composed of a screw cap, which has a hollow cylindrical jacket with an internal thread, and an annular tamper-evident strip, which is connected to the free edge of the jacket by means of predetermined breaking webs. Moreover, the tamper-evident strip has locking elements, which are provided for form-fit engagement in an abutment formed on a bottle neck. The first time the tamper-evident screw closure is opened, the screw cap is rotated and thereby lifted, whereas the tamper-evident strip is held on the abutment, such that the predetermined breaking webs tear some time during the opening procedure. It can thereby be seen that the bottle has already been opened.

Tamper-evident screw closures of this kind have the disadvantage that it is sometimes not possible to tell at first glance whether the bottle has already been opened. Tamper-evident screw closures of this kind with a screw cap and a tamper-evident strip have the further disadvantage that a relatively long bottle neck is required in order to be able to comfortably open the screw cap using the fingers.

The document WO 95/14617 discloses a tamper-evident screw closure comprising a circular head part and a hollow cylindrical jacket, wherein a tamper-evident part is arranged in the jacket and is connected to the jacket via bridges that are able to be broken. A disadvantage of this tamper-evident screw closure is the fact that considerable force has to be applied to open it, and that it is not always immediately apparent that the tamper-evident screw closure has been opened. The fact that it has been opened is immediately apparent when the entire tamper-evident part has been completely removed.

DISCLOSURE OF THE INVENTION

The object of the present invention is therefore to form a more advantageous closing cap, a more advantageous container neck and a more advantageous tamper-evident closure, the opening of which can be better discerned and/or which is also suitable for closing containers with short necks.

The object is achieved in particular by a closing cap made of plastic for closing a container, comprising a head part and a jacket part, wherein the jacket part is shaped substantially like a hollow cylinder and has a longitudinal axis, wherein the jacket part extends from the head part along the longitudinal axis, wherein the jacket part has an end portion at the end opposite the head part, and wherein the closing cap comprises a tamper-evident part and bridge parts, wherein the tamper-evident part is arranged at a distance from the jacket part and is connected to the end portion of the jacket part by bridge parts, and wherein the tamper-evident part is arranged in the direction of extension of the longitudinal axis along the end portion, such that the tamper-evident part is arranged at a distance from the jacket part in a direction radial to the longitudinal axis and extends in a circumferential direction to the longitudinal axis along the outside of the jacket part.

The object is further achieved in particular by a tamper-evident closure comprising a closing cap, and comprising a container neck, wherein the container neck and the closing cap are connected to each other in a mutually movable manner via a thread or a push-pull connection, such that the closing cap can be released from the container neck by being rotatable about the longitudinal axis and/or by being movable in the direction of the longitudinal axis, wherein the container neck comprises an engagement part which is connected to the container neck via a connection site, wherein the engagement part extends in the direction of extension of the longitudinal axis, and wherein the engagement part is arranged in such a way that the engagement part extends along the outside of the jacket part when the closing cap is connected to the container neck, wherein the engagement part has a projection such as a barb, wherein the projection is arranged in the direction of extension of the longitudinal axis between the head part and the tamper-evident part, and wherein the tamper-evident part protrudes past the projection radially with respect to the longitudinal axis, such that, when the closing cap is being opened for the first time, the tamper-evident part comes into contact with the projection and is damaged by the latter.

The object is further achieved in particular by a container neck having a pour channel which extends in the direction of a longitudinal axis and which opens into an outlet opening, wherein the container neck has, toward the outlet opening, a front portion and, adjoining the front portion in the direction of the longitudinal axis, a rear portion, and wherein the container neck has, on the outside of the front portion, an outer thread or an engagement means for securing a closing cap, wherein the outer thread or the engagement means has a depth radial to the longitudinal axis, and wherein the container neck has, in the rear portion, a connection site and an engagement part, wherein the connection site extends radially with respect to the longitudinal axis, and wherein the engagement part, starting from the connection site, extends in the direction of the longitudinal axis and toward the outlet opening, and wherein the container neck has a support part which is arranged opposite the engagement part, such that a gap extending in the direction of the longitudinal axis forms between the support part and the engagement part, and wherein the support part has a width, radial to the longitudinal axis, which width is at least as great as the depth of the outer thread or of the engagement means.

The object is further achieved in particular by a method for producing a tamper-evident closure by connecting a closing cap to a container neck, wherein a front portion of the container neck is inserted into the closing cap by pushing or turning, and wherein a tamper-evident part of the closing cap, during the connection of the closing cap to the container neck, is pressed through the engagement part against a shoulder of the closing cap, such that, during the connection, the tamper-evident part bears at least temporarily in a defined position on the shoulder, in order to avoid excessive tensile forces on bridge parts during the connection, wherein the bridge parts connect the tamper-evident part to the closing cap.

The closing cap according to the invention has the advantage that its first time of opening can usually be easily discerned, since the tamper-evident part is arranged extending on the outside of the jacket part of the closing cap, and since the tamper-evident part is damaged when the closing cap is being opened for the first time, such that the damaged tamper-evident part can be easily seen from the outside. Advantageously, the damaged tamper-evident part protrudes from the surface of the jacket part of the closing cap, such that the damaged tamper-evident part can be seen particularly clearly. The tamper-evident closure according to the invention comprises the closing cap according to the invention, with the tamper-evident part extending at least along a section of the closing cap in the circumferential direction, and comprises a container neck, preferably a bottle with a bottle neck, on which the closing cap is secured. The container neck comprises an engagement part, which is designed and arranged in such a way that the tamper-evident part is damaged when the closing cap is opened.

The closing cap according to the invention and the tamper-evident closure according to the invention have the advantage that the jacket part of the closing cap can be made relatively long in the longitudinal direction thereof. Thus, for example, a bottle usually has a bottle neck ring. A known tamper-evident closure is composed of a closing cap which is connected to a tamper-evident strip via predetermined break points, wherein the tamper-evident strip is arranged immediately after the bottle neck ring, and the predetermined break points and the closing cap are arranged in succession after the tamper-evident strip in the direction of extension of the bottle neck. A tamper-evident closure of this kind is relatively long in the direction of extension of the bottle neck. In the tamper-evident closure according to the invention, the tamper-evident part is arranged extending around the outside of the closing cap, the result of which is that the closing cap can be arranged directly after the bottle neck ring. The length that was needed for the tamper-evident part in the known tamper-evident closure can be utilized, in the tamper-evident closure according to the invention, to correspondingly increase the length of the closing cap. The tamper-evident closure according to the invention thus makes it possible to increase the overall length of the closing cap or, more advantageously, to leave the overall length of the closing cap at the previously customary dimension and so shorten the bottle neck. This allows the tamper-evident closure and/or the container neck or bottle neck to be produced using less material. In view of the large number of plastic bottles that are produced, the tamper-evident closure according to the invention permits considerable savings in material.

The invention is described in detail below on the basis of a number of illustrative embodiments.

BRIEF DESCRIPTION OF THE DRAWINGS

In the drawings used to explain the illustrative embodiments:

FIG. 3 shows a longitudinal section through the tamper-evident closure according to FIG. 2;

FIG. 4 shows a cross section of the tamper-evident closure according to FIG. 3 along the section line A-A;

FIG. 9 shows a cross section through the closing cap shown in FIG. 8, along the section line B-B;

FIG. 10 shows a cross section through the further closing cap shown in FIG. 1, along the section line B-B;

In the drawings, identical parts are in principle provided with identical reference signs.

WAYS OF IMPLEMENTING THE INVENTION

Figure 1:
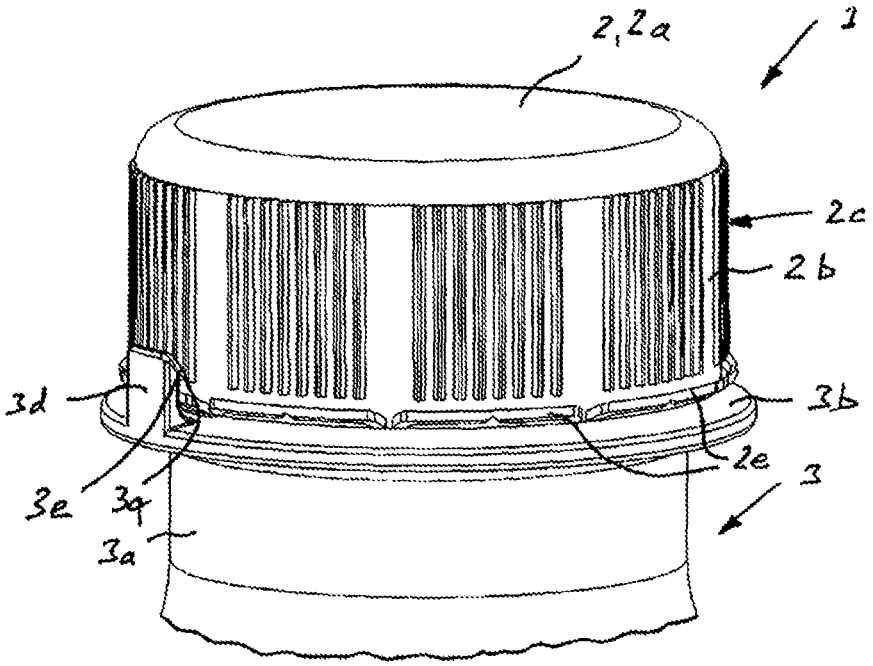
FIG. 1 shows a perspective view of a first illustrative embodiment of a tamper-evident closure.

FIG. 1 is a perspective view showing a first illustrative embodiment of a tamper-evident closure 1 comprising a closing cap 2 and a container neck 3*a* with a container neck ring 3*b*, and with an outlet opening 3*h* which is not visible. The closing cap 2 comprises a disk-shaped head part 2*a*, and a jacket part 2*b* with a partially structured surface 2*c*. Along the outside of the jacket part 2*b*, a plurality of tamper-evident parts 2*e* are arranged at a distance from each other in the circumferential direction. An engagement part 3*d* with a projection 3*q* is arranged on the container neck ring 3*b*, wherein, in the illustrative embodiment shown, the engagement part 3*d* is designed as a hook part and the projection 3*q* is designed as a barb 3*e*. During the opening of the closing cap 2, at least one tamper-evident part 2*e* will catch on the barb 3*e* and thus be damaged, such that, from the state of the tamper-evident parts 2*e*, it can be seen from the outside whether the closing cap 2 has already been opened.

Figure 2:
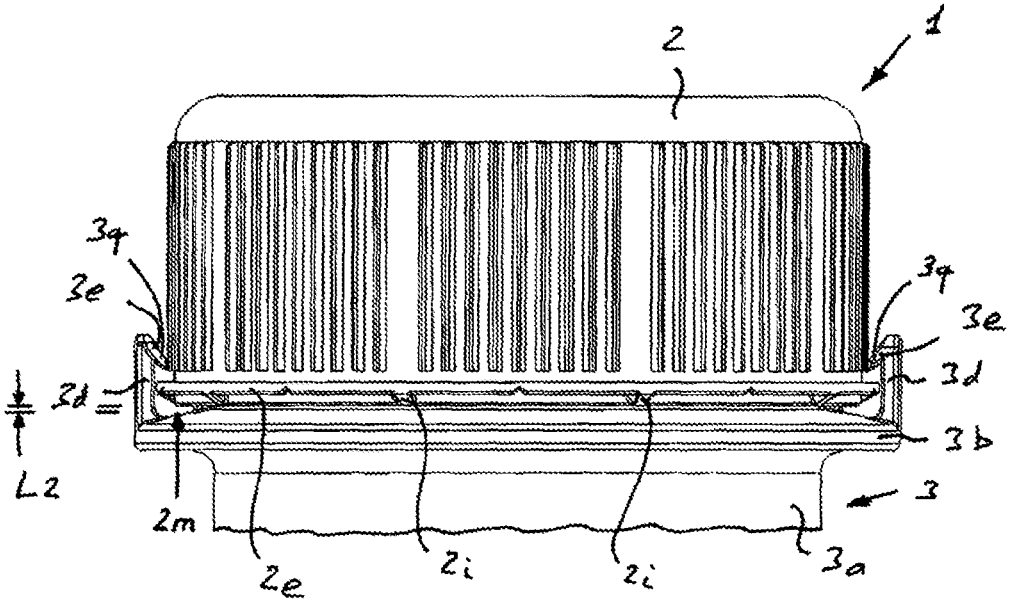
FIG. 2 shows a side view of a second illustrative embodiment of a tamper-evident closure.
Figure 5:
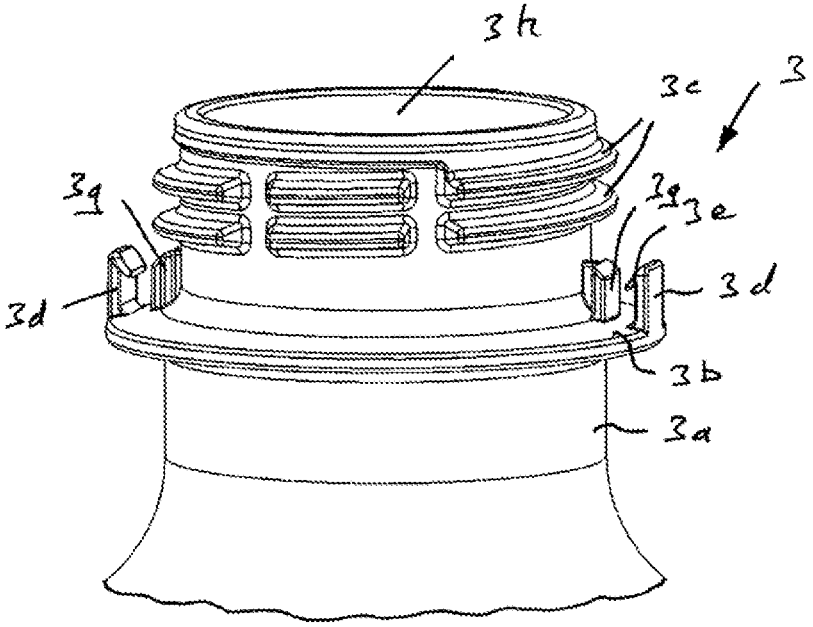
FIG. 5 shows a perspective view of the container neck according to FIG. 3, without the tamper-evident screw closure being fitted thereon.
Figure 6:
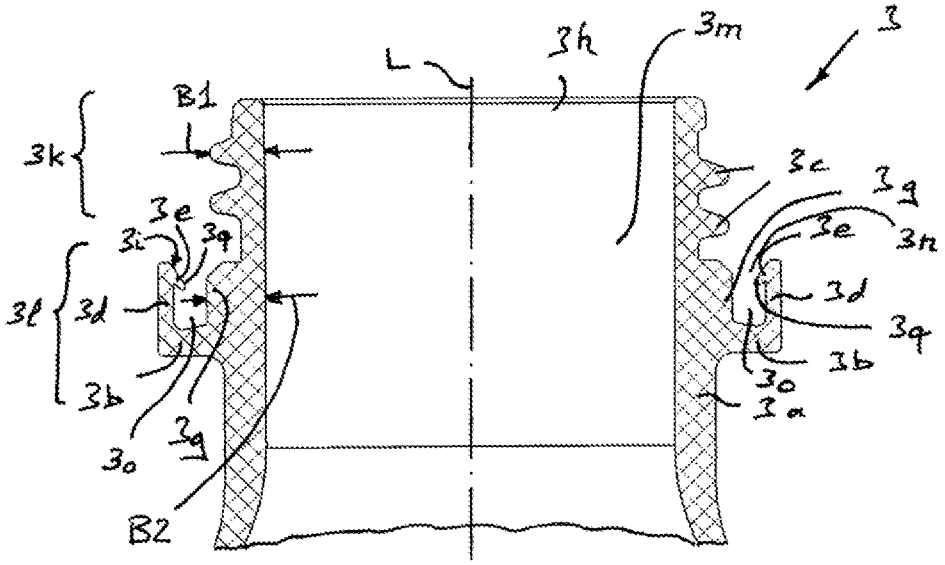
FIG. 6 shows a longitudinal section through the container neck according to FIG. 5.
Figure 7:
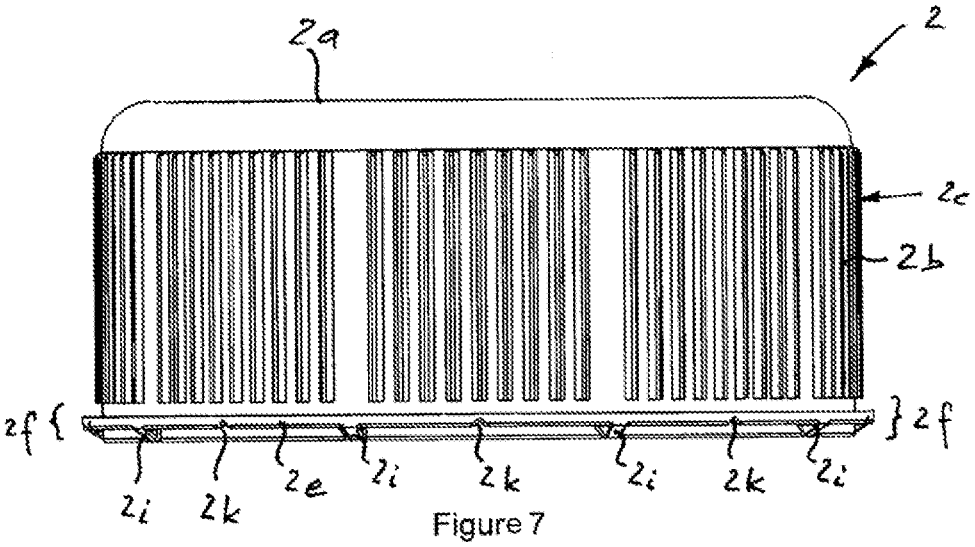
FIG. 7 shows a side view of the closing cap according to FIG. 2.
Figure 8:
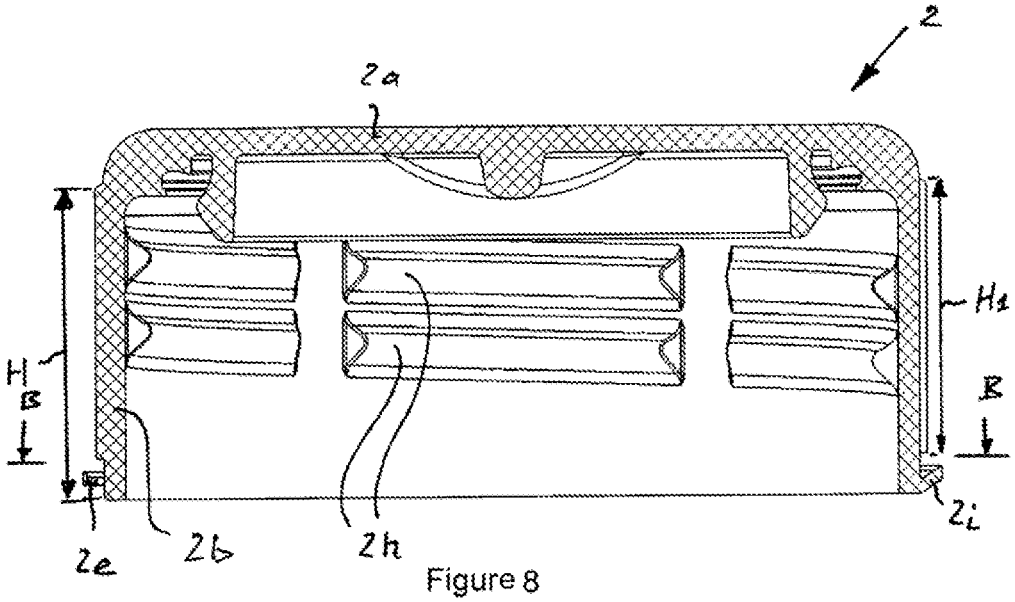
FIG. 8 shows a longitudinal section through the closing cap according to FIG. 7.

A second illustrative embodiment of a tamper-evident closure 1 comprising a closing cap 2 and a container neck 3*a* with outlet opening 3*h* is shown in FIGS. 2 to 9. FIG. 2 shows a side view, and FIG. 3 a section of the tamper-evident closure 1. As can be seen from FIG. 3, the closing cap 2 comprises a head part 2*a* and a jacket part 2*b*, wherein the jacket part 2*b* is shaped substantially like a hollow cylinder and has a longitudinal axis L. Starting from the head part 2*a*, the jacket part 2*b* extends in the direction of the longitudinal axis L, wherein the jacket part 2*b*, as is shown in FIGS. 3 and 7, has an end portion 2*f* at the end opposite the head part 2*a*. The closing cap 2 comprises a ring-shaped tamper-evident part 2*e* and a plurality of bridge parts 2*i*, wherein the tamper-evident part 2*e* is arranged at a radial distance from the jacket part 2*b* and is connected to the end portion 2*f* of the jacket part 2*b* by bridge parts 2*i*, wherein the tamper-evident part 2*e* is arranged in the direction of extension of the longitudinal axis L along and inside the end portion 2*f*, such that the tamper-evident part 2*e* is arranged at a distance from the jacket part 2*b* in a direction radial to the longitudinal axis L and extends in a circumferential direction to the longitudinal axis L along the outside of the jacket part 2*b*. In an advantageous embodiment, as is shown in FIGS. 2 and 7, the tamper-evident part 2*e* has a plurality of weak points 2*k* which are spaced apart in the circumferential direction in order to provide defined break points. In an advantageous embodiment, the surface of the jacket part 2*b* is provided with a structured surface 2*c*. In an advantageous embodiment, as can be seen from FIG. 3, the tamper-evident closure is designed as a rotary closure, wherein the container neck 3*a* has an outer thread 3*c*, and wherein the closing cap 2 has, on the inside 2*d*, an inner thread 2*h* adapted to the outer thread 3*c*, such that the closing cap 2 can be released from the container neck 3*a* by being rotatable about the longitudinal axis L.

As can be seen from FIGS. 2, 3, 5 and 6, the container neck 3*a* comprises an engagement part 3*d* which is connected to the container neck 3*a* via a connection site 3*b*, wherein the engagement part 3*d* extends in the direction of extension of the longitudinal axis L, and wherein the engagement part 3*d* is arranged in such a way that the engagement part 3*d* extends along the outside of the jacket part 2*b* when the closing cap 2 is connected to the container neck 3*a*. The engagement part 3*d* has a projection 3*q* designed as a barb 3*e*, wherein the barb 3*e* is arranged in the direction of extension of the longitudinal axis L between the head part 2*a* and the tamper-evident part 2*e*. As can be seen from FIGS. 2 and 3, the tamper-evident part 2*e* protrudes past the barb 3*e* radially with respect to the longitudinal axis L, such that, when the closing cap 2 is being opened for the first time, the tamper-evident part 2*e* comes into contact with the barb 3*e* and is damaged by the latter, for example as a result of the tamper-evident part 2*e* being torn and/or the bridge part 2*i* being torn and/or the weak point 2*k* being torn. The projection 3*q* or barb 3*e* can be designed in many different ways, for example also as an abutment part which prevents or impedes passage of the tamper-evident part 2*e* and therefore damages the tamper-evident part 2*e*.

The container neck 3*a* shown in FIGS. 2, 3 and 5 and in particular in FIG. 6 has a pour channel 3*m* which extends in the direction of a longitudinal axis L and which opens into an outlet opening 3*h*, wherein the container neck 3*a* has, toward the outlet opening 3*h*, a front portion 3*k* and, adjoining the front portion 3*k* in the direction of the longitudinal axis L, a rear portion 3*l*. The container neck 3*a* has, on the outside of the front portion 3*k*, an outer thread 3*c* or an engagement means 3*p* for securing a closing cap 2, wherein the outer thread 3*c* or the engagement means 3*p* has a depth B1 radial to the longitudinal axis L. The container neck 3*a* has, in the rear portion 3*l*, a connection site 3*b* and an engagement part 3*d*, wherein the connection site 3*b* extends radially with respect to the longitudinal axis L, and wherein the engagement part 3*d*, starting from the connection site 3*b*, extends in the direction of the longitudinal axis L and toward the outlet opening 3*h*. The container neck 3*a* comprises a support part 3*g* which is arranged opposite the engagement part 3*d*, such that a gap 3*o* extending in the direction of the longitudinal axis L forms between the support part 3*g* and the engagement part 3*d*, wherein the support part 3*g* has a width B2, radially with respect to the longitudinal axis L, that is at least as great as the depth B1. The width B2 can also be greater than the depth B1. In an advantageous embodiment as can be seen from FIG. 3, the closing cap 2 has, in the area of the end portion 2*f*, an internal diameter which is the same as or slightly greater than the external diameter of the support part 3*g*, such that, as can be seen from FIG. 3, the closing cap in the area of the end portion 2*f* comes to lie on the outer surface of the support part 3*g*. The support part 3*g* prevents an excursion of the wall of the closing cap in the direction toward the longitudinal axis L, particularly when the projection 3*q* of the engagement part 3*d* bears on the tamper-evident part 2*e* and damages the latter.

The feature whereby the width B2 is at least as great as the depth B1 ensures that the end portion 2*f* of the closing cap 2 can be guided past the outer thread 3*c* during the fitting onto the container neck 3*a*, and that the inside of the end portion 2*f* of the closing cap 2 lies close to or touches the outer surface of the support part 3*g* when the closing cap 2 has been fitted on the container neck 3*a*.

As can be seen from FIG. 6, the container neck 3*a* is designed in such a way that the engagement part 3*d* has a projection 3*q* on the end portion opposite the connection site 3*b*, wherein the projection 3*q* is oriented toward the support part 3*g* and protrudes into the gap 3*o*. In the illustrative embodiment shown, the engagement part 3*d* comprises a barb 3*e*, wherein the projection 3*q* is part of the barb 3*e*, such that the barb 3*e* is oriented toward the support part 3*g* and protrudes into the gap 3*o*. The engagement part 3*d* has, in the direction toward the outlet opening 3*h*, a guide face 3*i* extending transversely with respect to the longitudinal axis L, in such a way that the guide face 3*i*, in the direction toward the connection site 3*b*, forms a narrowing gap 3*n*. Advantageously, as is shown in FIGS. 4 and 5, the container neck 3*a* comprises two engagement parts 3*d*, which are arranged offset by 180 degrees with respect to the longitudinal axis L. Advantageously, the connection site 3*b* is designed as a container neck ring 3*b*. In the illustrative embodiment shown, the support part 3*g* is as wide as the engagement part 3*d* in the circumferential direction. In a further advantageous embodiment, the support part 3*g* is designed as a projection extending through 360° about the longitudinal axis L. The container neck 3*a* could also comprise a plurality of engagement parts 3*d* and support parts 3*g*, for example 3, 4, 5 or 6, that are arranged in a distributed manner in the circumferential direction.

The tamper-evident closure 1 requires at least a single engagement part 3*d* with projection 3*q* such as a barb 3*e*. In an advantageous embodiment, a plurality of engagement parts 3*d* with projections 3*q* or barbs 3*e* are arranged spaced apart in the circumferential direction. As is shown in FIGS. 2, 3, 5 and 6, an arrangement is particularly advantageous in which two engagement parts 3*d* are arranged offset with respect to each other by 180 degrees.

In one possible embodiment, the connection site 3*b* can be designed as a bridge part with in the circumferential direction thereof or a similar width as the engagement part 3*d*. In an advantageous embodiment as can be seen in FIGS. 3 to 6, the connection site 3*b* is designed as a container neck ring 3*b*.

Figure 11:
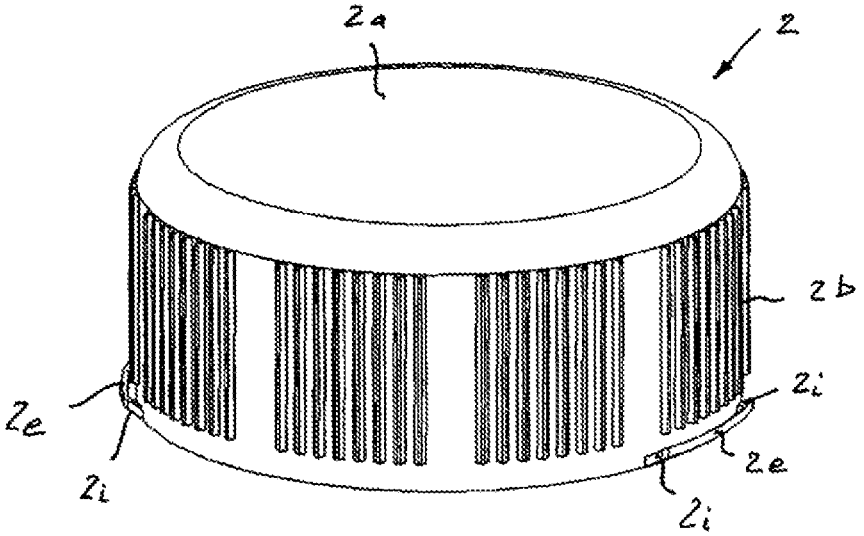
FIG. 11 shows a perspective view of a further closing cap.

The tamper-evident parts 2*e* can be provided in many possible designs. The closing cap 2 comprises at least one tamper-evident part 2*e*, which is connected to the jacket part 2*b* by bridge parts 2*i*. The tamper-evident part 2*e* extends through at least 5 degrees in the circumferential direction of the longitudinal axis L. Advantageously, as can be seen in FIGS. 1 and 10, a plurality of tamper-evident parts 2*e* are arranged spaced apart from each other in the circumferential direction of the longitudinal axis L. In an advantageous embodiment, as is shown in FIG. 11, the closing cap 2 comprises two tamper-evident parts 2*e*, which are arranged offset with respect to each other by 180 degrees in the circumferential direction of the longitudinal axis L. In another advantageous embodiment, the closing cap 2 comprises an uneven number of tamper-evident parts 2*e* and/or an uneven number of bridge parts 2*i*. This ensures that, for example in the arrangement shown in FIG. 5 with two engagement parts 3*d* offset by 180 degrees, a tamper-evident part 2*e* bears at least on one of the two engagement parts 3*e* in such a way that, during the opening procedure, said tamper-evident part is similarly damaged reliably and preferably reproducibly.

In another advantageous embodiment, as is shown in FIGS. 2, 7 and 9, the closing cap 2 comprises a single tamper-evident part 2*e*, wherein the tamper-evident part 2*e* has a ring-shaped design and extends through 360 degrees.

Figure 12A:
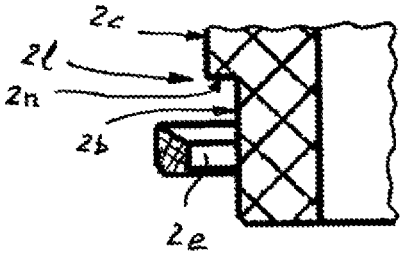
FIG. 12*a* shows a detailed view, bottom left, of the closing cap shown in FIG. 8.
Figure 12B:
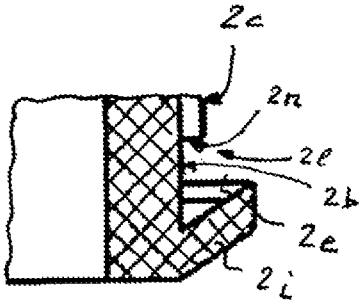
FIG. 12*b* shows a detailed view, bottom right, of the closing cap shown in FIG. 8.
Figure 13A:
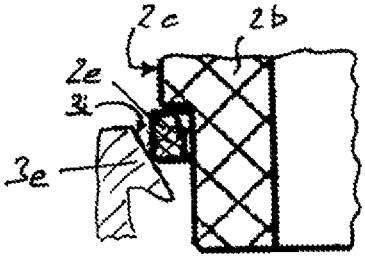
FIG. 13*a* shows the detailed view according to FIG. 12*a* during the securing of the closing cap on the container neck.
Figure 13B:
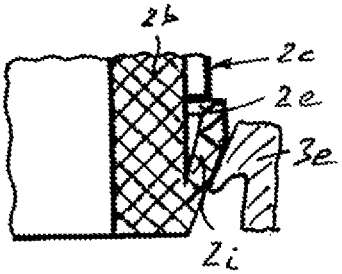
FIG. 13*b* shows the detailed view according to FIG. 12*b* during the securing of the closing cap on the container neck.

In an advantageous embodiment, as is shown in the detailed views according to FIGS. 12*a* and 12*b*, the closing cap 2 is designed in such a way that the jacket part 2*b* has a shoulder 2*l* on the outer surface, wherein the shoulder 2*l*, starting from the point of attachment of the bridge part 2*i* to the jacket part 2*b*, is arranged offset in the direction toward the head part 2*a*, wherein the shoulder 2*l* protrudes past the jacket part 2*b* to form a support surface 2*n*. As is shown in the detailed views according to FIGS. 13*a* and 13*b*, the shoulder 2*l* and the tamper-evident part 2*e* and the bridge part 2*i* are designed and arranged matching each other in such a way that, when a force acts on the tamper-evident part 2*e* in the direction of the head part 2*a* (for example, as shown in FIGS. 13*a*, 13*b*, by the barb 3*e*), the tamper-evident part 2*e* is movable toward the shoulder 2*l*, such that the tamper-evident part 2*e* bears on the shoulder 2*l* or on the support face 2*n*. This design has the advantage that, during the production of the tamper-evident closure 1, i.e. during the initial provision of the container neck 3*a* with the closing cap 2, it is ensured that the at least one tamper-evident part 2*e* and/or the bridge parts 2*i* are not damaged, since the tamper-evident part 2*e*, as is shown in FIGS. 13*a* and 13*b*, can bear on the shoulder or on the support face 2*n*. Advantageously, as is shown in FIGS. 13*a* and 13*b*, the engagement part 3*d* or the barb 3*e* has, toward the container neck 3*a* or toward the jacket part 2*b*, a guide face 3*i* extending obliquely with respect to the longitudinal axis L, wherein the guide face 3*i*, in the direction toward the connection site 3*b*, approaches the container neck 3*a* and forms a narrowing gap 3*n*. As is shown in FIGS. 13*a* and 13*b*, this design has the advantage that the tamper-evident part 2*e* is delivered precisely to the shoulder 2*l* or the support face 2*n*. In an advantageous embodiment, as shown in FIGS. 3, 4 and 6, the container neck 3*a* comprises a support part 3*g*, wherein the support part 3*g* is preferably arranged opposite the engagement part 3*d* in order to prevent an excursion of the jacket part 2*b* in the direction toward the longitudinal axis L in the state shown in FIGS. 13*a* and 13*b*. Moreover, the first time the tamper-evident closure 1 is opened, the support parts 3*g* also prevent any excursion of the jacket part 2*b* and therefore of the tamper-evident part 2*e* in the direction toward the longitudinal axis L. The support part 3*g* thus ensures reliable and reproducible damage of the tamper-evident part 2*e* the first time the tamper-evident closure 1 is opened.

Figure 14:
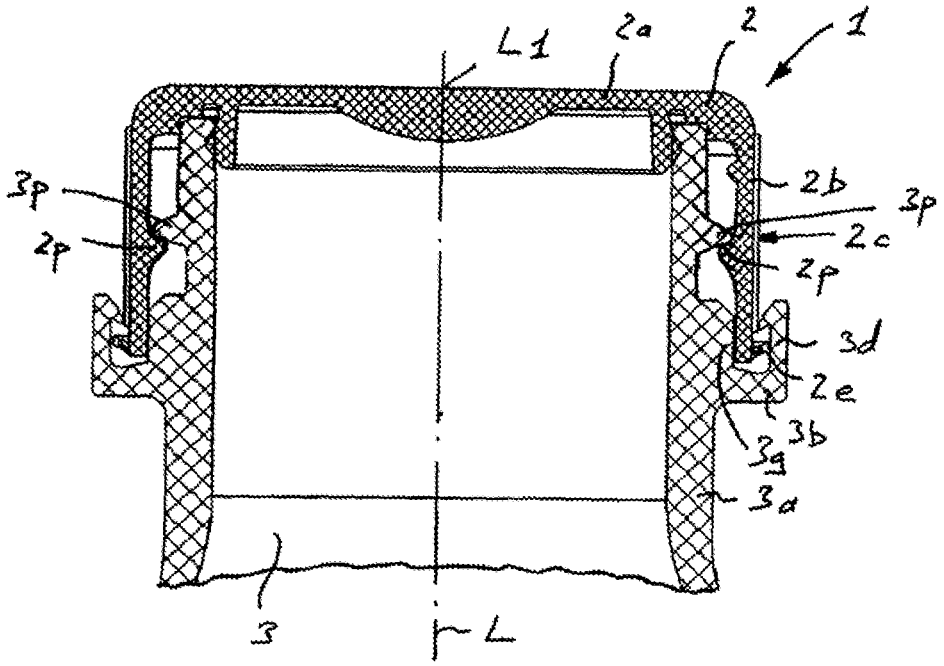
FIG. 14 shows a longitudinal section through a tamper-evident closure designed as a push-pull closure.

FIG. 14 shows, in a longitudinal section, a further illustrative embodiment of a tamper-evident closure 1. The closing cap 2 and the container neck 3*a* are designed matching each other in such a way that a so-called push-pull connection is formed, that is to say the closing cap 2 can be separated from the container neck 3*a* by a linear movement in the direction of the longitudinal axis L and, if necessary, can also be fitted back in place. In contrast to the embodiment shown in FIG. 3, the embodiment shown in FIG. 14 has no thread 3*c*, 2*h*, but instead preferably circular engagement means 2*p*, 3*p* that snap-fit onto each other and hold the closing cap 2 in the depicted position, wherein the closing cap 2 can be removed and put back in place again, and wherein the tamper-evident part 2*e* is damaged the first time the closing cap 2 is removed.

Figure 15:
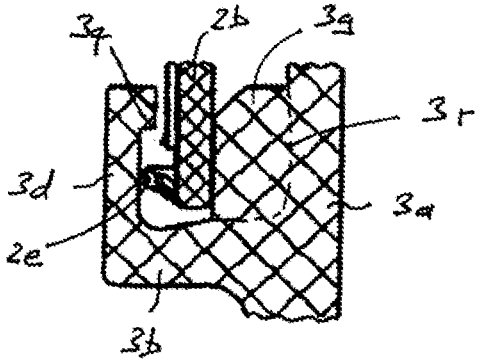
FIG. 15 shows a longitudinal section through a further illustrative embodiment of an engagement part.

FIG. 15 shows, in a detailed view, a further illustrative embodiment of an engagement part 3*d* which, in contrast to the embodiment shown in FIG. 3, has a rectangular projection 3*q* which, when the closing cap 2 is removed, bears on the tamper-evident part 2*e* and damages it. In a further illustrative embodiment, as is indicated by the broken line 3*r*, the support part 3*g* could be omitted, by means of the outer wall of the container neck 3*a* extending along the line 3*r*. The support part 3*g* could be omitted if the jacket part 2*b* of the closing cap 2 has a stable configuration such that it does not deform or does not appreciably deform in the area of the engagement part 3*d* in the direction toward the longitudinal axis L when the closing cap 2 is opened.

As is shown in FIGS. 2 and 3, the tamper-evident closure 1, in an advantageous embodiment, is designed in such a way that the closing cap 2 has an external diameter D, that the end 2*m* of the closing cap 2 oriented toward the container neck ring 3*b* is spaced apart from the container neck ring 3*b* by a distance L2 in the direction of the longitudinal axis L, and that the distance L2 is less than 2% of the external diameter D. The distance L2 is preferably less than 0.5 mm. An advantage of this design is that the height H of the closing cap 2 can be made particularly large, such that the jacket part 2*b* is made correspondingly long, such that the fingers can be placed very comfortably on the jacket part 2*b* or on the structured surface 2*c*. In previously known closing caps 2, there is sometimes the problem that the closing cap 2 has a small height H, such that the closing cap 2 is difficult to open. The closing cap 2 according to the invention has the advantage that, despite a short container neck 3*a*, it can be produced with a comfortable height H. The closing cap 2 according to the invention also has the advantage that the length of the container neck 3*a* can be reduced, and yet the closing cap 2 still has a comfortable height H for actuation with the fingers. The shorter container neck 3*a* means that material can be saved.

The tamper-evident closure 1 is advantageously produced in such a way that the closing cap 2 is connected to the container neck 3*a*, by a front portion 3*k* of the container neck 3*a* being inserted into the closing cap 2 by pushing or turning, by a tamper-evident part 2*e* of the closing cap 2, during the connection of the closing cap 2 to the container neck 3*a*, being pressed through the hook part 3*d* against a shoulder 2*l* of the closing cap 2, and by the tamper-evident part 2*e*, during the connection, bearing at least temporarily in a defined position on the shoulder 2*l*, in order to avoid excessive tensile forces on the bridge parts 2*i* during the connection.

The invention claimed is:

1. A tamper-evident closure comprising a closing cap made of plastic and a container neck, wherein the closing cap comprises a head part and a jacket part, wherein the jacket part is shaped substantially like a hollow cylinder and has a longitudinal axis, wherein the jacket part extends from the head part along the longitudinal axis, wherein the jacket part has an end portion at the end opposite the head part, and wherein the closing cap comprises a tamper-evident part and bridge parts, wherein the tamper-evident part is arranged at a distance from the jacket part and is connected to the end portion of the jacket part by said bridge parts, and wherein the tamper-evident part is arranged in a direction of an extension of the longitudinal axis along the end portion, such that the tamper-evident part is arranged at a distance from the jacket part in a direction radial to the longitudinal axis and extends in a circumferential direction to the longitudinal axis along the outside of the jacket part, and wherein the container neck and the closing cap are connected to each other in a mutually movable manner via a thread or a push-pull connection, such that the closing cap is releasable from the container neck by being rotatable about the longitudinal axis and/or by being movable in the direction of the longitudinal axis, wherein the container neck comprises an engagement part which is connected to the container neck via a connection site, wherein the engagement part extends in the direction of extension of the longitudinal axis, and wherein the engagement part is arranged in such a way that the engagement part extends along the outside of the jacket part when the closing cap is connected to the container neck, wherein the engagement part has a projection, wherein the projection is arranged in the direction of extension of the longitudinal axis between the head part and the tamper-evident part, and wherein the tamper-evident part protrudes past the projection radially with respect to the longitudinal axis, such that, when the closing cap is being opened for the first time, the tamper-evident part comes into contact with the projection and is damaged by said projection.

2. The tamper-evident closure as claimed in claim 1, wherein the engagement part has, toward the container neck, a guide face extending obliquely with respect to the longitudinal axis, wherein the guide face, in the direction toward the connection site, approaches the container neck.

3. The tamper-evident closure as claimed in claim 1, wherein the engagement part comprises a barb, wherein the projection is part of the barb.

4. The tamper-evident closure as claimed in claim 1, wherein the container neck comprises a support part, and in that the support part is arranged opposite the engagement part.

5. The tamper-evident closure as claimed in claim 1, wherein the connection site is designed as a container neck ring.

6. The tamper-evident closure as claimed in claim 5, wherein the closing cap has an external diameter, in that the end of the closing cap oriented toward the container neck ring is spaced apart from the container neck ring by a distance in the direction of the longitudinal axis, and in that the distance is less than 2% of the external diameter.

7. A container neck having a pour channel which extends in the direction of a longitudinal axis and which opens into an outlet opening, wherein the container neck has, toward the outlet opening, a front portion and, adjoining the front portion in the direction of the longitudinal axis, a rear portion, and wherein the container neck has, on the outside of the front portion, an outer thread or an engagement means for securing a closing cap, wherein the outer thread or the engagement means has a depth radial to the longitudinal axis, and wherein the container neck has, in the rear portion, a connection site and an engagement part, wherein the connection site extends radially with respect to the longitudinal axis, and wherein the engagement part, starting from the connection site, extends in the direction of the longitudinal axis and toward the outlet opening, and wherein the container neck has a support part which is arranged opposite the engagement part, such that a gap extending in the direction of the longitudinal axis forms between the support part and the engagement part, and wherein the support part has a width, radial to the longitudinal axis, which width is at least as great as the depth.

8. The container neck as claimed in claim 7, wherein the engagement part has a projection on an end portion opposite the connection site, wherein the projection is oriented toward the support part and protrudes into the gap.

9. The container neck as claimed in claim 8, wherein the engagement part comprises a barb, wherein the projection is part of the barb, such that the barb is oriented toward the support part and protrudes into the gap.

10. The container neck as claimed in claim 7, wherein the engagement part has, in the direction toward the outlet opening, a guide face which extends transversely with respect to the longitudinal axis, in such a way that the guide face, in the direction toward the connection site, forms a narrowing gap.

11. The container neck as claimed in claim 7, wherein it comprises two engagement parts, which are arranged offset by 180 degrees with respect to the longitudinal axis.

12. The container neck as claimed in claim 7, wherein the connection site is designed as a container neck ring.

13. A container or container neck comprising a tamper-evident closure as claimed in claim 1.

14. A method for producing a tamper-evident closure by connecting a closing cap to a container neck having a pour channel which extends in a direction of a longitudinal axis and which opens into an outlet opening, wherein container neck has, toward the outlet opening, a front portion and, adjoining the front portion in the direction of the longitudinal axis, a rear portion, and wherein the container neck has, on the outside of the front portion, an outer thread or an engagement means for securing a closing cap, wherein the outer thread or the engagement means has a depth radial to the longitudinal axis, and wherein the container neck has, in the rear portion, a connection site and an engagement part, wherein the connection site extends radially with respect to the longitudinal axis, and wherein the engagement part, starting from the connection site, extends in the direction of the longitudinal axis and toward the outlet opening, and wherein the container neck has a support part which is arranged opposite the engagement part, such that a gap extending in the direction of the longitudinal axis forms between the support part and the engagement part, and wherein the support part has a width, radial to the longitudinal axis, which width is at least as great as the depth, the method comprising:

inserting a front portion of the container neck into the closing cap by pushing or turning; and connecting the a tamper-evident part of the closing cap to the container neck, by pressing the engagement part against a shoulder of the closing cap in such a way that, during the connection, the tamper-evident part bears at least temporarily in a defined position on the shoulder, in order to avoid excessive tensile forces on bridge parts, joining the tamper-evident part to the closing cap, during the connection.

* * * * *